US009666003B2

(12) United States Patent
Shiraishi et al.

(10) Patent No.: US 9,666,003 B2
(45) Date of Patent: May 30, 2017

(54) OBJECT DETECTION SYSTEM

(71) Applicant: OPTEX CO., LTD., Shiga (JP)

(72) Inventors: Masanao Shiraishi, Shiga (JP); Hiroyuki Ohba, Shiga (JP); Yasuhiro Takada, Shiga (JP); Mitsugu Mihara, Shiga (JP); Akihiro Ikeuchi, Shiga (JP)

(73) Assignee: OPTEX CO., LTD., Shiga (JP)

( * ) Notice: Subject to any disclaimer, the term of this patent is extended or adjusted under 35 U.S.C. 154(b) by 213 days.

(21) Appl. No.: 14/293,144

(22) Filed: Jun. 2, 2014

(65) Prior Publication Data

US 2014/0361868 A1 Dec. 11, 2014

(30) Foreign Application Priority Data

Jun. 6, 2013 (JP) ..... 2013-119600

(51) Int. Cl.
*G07C 9/00* (2006.01)
*E05F 15/73* (2015.01)
*E05F 15/77* (2015.01)

(52) U.S. Cl.
CPC ..... *G07C 9/00174* (2013.01); *E05F 15/73* (2015.01); *E05F 15/77* (2015.01); (Continued)

(58) Field of Classification Search
CPC ..... E05F 15/77; E05F 15/73; E05F 15/74; G07C 2209/63; G07C 9/00174; G07C 2009/00841; G07C 9/00126
See application file for complete search history.

(56) References Cited

U.S. PATENT DOCUMENTS 5,444,439 A 8/1995 Kuroda et al.
5,453,736 A * 9/1995 Noren ..... G05B 19/409 340/5.6

(Continued)

FOREIGN PATENT DOCUMENTS

JP H02-090296 A 3/1990
JP 2000-320245 A 11/2000

(Continued)

OTHER PUBLICATIONS

"Combined Search and Examination Report under Sections 17 and 18(3)," issued by the British Intellectual Property Office on Oct. 28, 2014, which corresponds to British Patent Application No. GB1409953.5 and is related to U.S. Appl. No. 14/293,144.

(Continued)

*Primary Examiner* — An T Nguyen
(74) *Attorney, Agent, or Firm* — Studebaker & Brackett PC

(57) ABSTRACT

An object detection system 1 includes a sensor section 10 configured to detect an object within a detection area A; and an adjuster (remote controller) 20 configured to interactively communicate with the sensor section 10. The adjuster 20 includes; a transmission unit 13 configured to transmit a setting signal for setting an operating condition of the sensor section 10 to the sensor section 10; an adjustment notification unit 23 configured to receive a completion signal of operating condition setting from the sensor section 10 and give notification of the operating condition, setting of which has been completed; and a target selection unit 25 configured to arbitrarily select a target sensor section 10 intended for the operating condition setting.

2 Claims, 9 Drawing Sheets

(52) U.S. Cl.
CPC ..... *G07C 2009/00841* (2013.01); *G07C 2209/63* (2013.01)

(56) References Cited

U.S. PATENT DOCUMENTS 5,789,887 A * 8/1998 Elischewski ..... G05B 19/0428 318/286
5,854,594 A * 12/1998 Lin ..... G08C 19/28 340/12.53
6,634,408 B2 * 10/2003 Mays ..... G07C 9/00309 160/188
7,164,119 B2 * 1/2007 Iwasawa ..... G01V 8/12 250/205
7,737,862 B2 6/2010 Watanabe
8,099,902 B2 * 1/2012 Christensson ..... H04N 7/186 49/25
8,653,962 B2 * 2/2014 Maeng ..... G08B 21/24 340/10.3
2001/0030689 A1 * 10/2001 Spinelli ..... H04N 7/183 348/155
2005/0123109 A1 * 6/2005 Yamagishi ..... H04L 12/12 379/102.01
2005/0262272 A1 * 11/2005 Christensen ..... G01D 21/00 710/8
2006/0187034 A1 * 8/2006 Styers ..... G05B 9/02 340/545.1
2006/0244403 A1 * 11/2006 Christensson ..... E05F 15/73 318/280
2006/0270458 A1 11/2006 Watanabe
2007/0024708 A1 * 2/2007 Lin ..... H04N 7/181 348/143
2007/0157642 A1 * 7/2007 Ferragut ..... F25D 29/00 62/139
2007/0159321 A1 * 7/2007 Ogata ..... A61B 5/0002 340/539.12
2007/0293208 A1 * 12/2007 Loh ..... H04L 12/282 455/419
2008/0198062 A1 * 8/2008 Mezger ..... G01S 7/40 342/27
2009/0219188 A1 * 9/2009 Mezger ..... G01S 7/40 342/27
2010/0085164 A1 * 4/2010 Beij ..... H05B 37/0272 340/10.5
2011/0018754 A1 1/2011 Tojima et al.
2011/0292282 A1 12/2011 Isozu
2012/0075091 A1 * 3/2012 Clough ..... E05F 15/70 340/501
2013/0049929 A1 * 2/2013 Gerlach ..... E05F 15/77 340/5.64
2014/0258497 A1 * 9/2014 Kiyomasa ..... G05B 23/00 709/223
2014/0361146 A1 * 12/2014 Shiraishi ..... E05F 15/77 250/206
2014/0361868 A1 * 12/2014 Shiraishi ..... G07C 9/00174 340/5.2
2015/0059086 A1 * 3/2015 Clough ..... G08C 17/02 5/83.1
2015/0097651 A1 * 4/2015 Clough ..... E05F 15/77 340/5.7
2015/0106105 A1 * 4/2015 Clough ..... G07C 9/00126 704/275

FOREIGN PATENT DOCUMENTS

JP 2003-090169 A 3/2003
JP 2006-325046 A 11/2006
JP 2007-231665 A 9/2007
JP 2009-013714 A 1/2009
JP 2009-164804 A 7/2009
JP 2009-260934 A 11/2009
JP 2011-254238 A 12/2011

OTHER PUBLICATIONS

Office Action issued by the Japanese Patent Office on Feb. 21, 2017, which corresponds to Japanese Patent Application No. 2013-119600 and is related to U.S. Appl. No. 14/293,144; with English Language Summary; 6pp.

* cited by examiner

OBJECT DETECTION SYSTEM

CROSS REFERENCE TO THE RELATED APPLICATION

This application is based on and claims Convention priority to Japanese patent application No. 2013-119600, filed Jun. 6, 2013, the entire disclosure of which is herein incorporated by reference as a part of this application.

BACKGROUND OF THE INVENTION (Field of the Invention)

The present invention relates to an object detection system including a sensor section which detects an object within a detection area and an adjuster (remote controller) which sets an operating condition of the sensor section.

(Description of Related Art)

Conventionally, a sensor (sensor section) is known which detects an object such as a human body by using detection rays such as infrared rays, microwaves, or the like within a detection area. The sensor is used, for example, as an automatic door sensor for object detection of an automatic door apparatus.

In general, an automatic door apparatus includes a plurality of automatic constituent devices such as a door controller which controls a speed of an automatic door and the like and a sensor section for detecting a passer or the like. In addition, an object detection system is also known in which setting of an operating parameter (operating condition) of each device of an automatic door apparatus is performed by a single adjuster (remote controller) provided independently of the automatic door apparatus. An example of the object detection system is a system in which a single remote controller sets an opening speed and a closing speed of a door, an open timer, and the like which are operating parameters of each device constituting an automatic door apparatus, and performs area setting for determining what distance from a door opening is defined as a detection area of a sensor section, etc. (e.g., Japanese Laid-Open Patent Publication No. 2007-231665).

The detection area of the sensor section is set, for example, by adjusting a tilt angle of a sensor main body or an optical system and is generally adjusted so as to have a predetermined depth and width with respect to the automatic door by manually operating a Dip switch, an angle adjustment mechanism, or the like which is provided within the main body and interlocks with a screw or the like.

Meanwhile, in Japanese Laid-Open Patent Publication No. 2007-231665, an operating condition of each device of the automatic door apparatus is set by a single remote controller. In the case where a plurality of automatic door constituent devices are connected to a bus, it is necessary to initially select a device desired to be set from among the plurality of constituent devices. It is appropriate if each recognition code in a recognition code list displayed at that time is interpretable by a setting person. However, for example, if the recognition code is only number information such as a serial number at the time of production, the setting person needs to previously know which number is allocated to a device desired to be set. When a plurality of constituent devices are set, the setting operation is very complicated and difficult, which is a problem.

In addition, even when type information is included in the displayed recognition code list, there is a case where the same type of a plurality of devices (e.g., internal and external activation sensor sections) are connected in an automatic door configuration; and in this case, same type information is lined in the recognition code list, it cannot be recognized which recognition code corresponds to the internal activation sensor section and which recognition code corresponds to the external activation sensor section, and it is difficult to select a sensor section desired to be set from among a plurality of the sensor sections, which is a problem.

SUMMARY OF THE INVENTION

An object of the present invention is to provide an object detection system which solves the above-described problems and which allows only an arbitrary sensor section desired to be set, to be easily selected, prevents false setting, is easily handled, and allows an operating condition to be easily set for each sensor section, even in the case where a plurality of sensor sections are provided.

In order to achieve the above-described object, an object detection system according to the present invention includes: a sensor section configured to detect an object within a detection area; and an adjuster configured to interactively communicate with the sensor section. The adjuster includes: a transmission unit configured to transmit a setting signal for setting an operating condition of the sensor section to the sensor section; an adjustment notification unit configured to receive a completion signal of operating condition setting from the sensor section and give notification of the operating condition, setting of which has been completed; and a target selection unit configured to arbitrarily select a target sensor section intended for the operating condition setting.

According to this configuration, since the adjuster (remote controller) includes the target selection unit configured to arbitrarily select a target sensor section intended for the operating condition setting, even in the case where a plurality of sensor sections are provided, it is possible to select only an arbitrary sensor section by the same type of the adjuster, it is possible to prevent false setting of another sensor section. Furthermore, it is possible to easily set the operating condition for each sensor section by the adjuster.

In the present invention, setting information of the operating condition is preferably transmitted from the sensor section to the adjuster. Therefore, since the setting information of the operating condition is previously stored in the sensor section, for example, even when the types of the sensor sections are different and thus operating condition items are different, it is possible to handle this case with only one type of the adjuster (remote controller) in combination with arbitrary selection of a sensor section. Thus, the development cost is reduced. Moreover, for a user, it is possible to easily set an operating condition of an arbitrary sensor section. Furthermore, since one type of the remote controller is used, the operation is the same, and management is not complicated. In the case where the setting information is previously stored in the adjuster, the adjuster can support only a specified type of a sensor section, and when a sensor section that cannot be supported by the adjuster is desired to be set, another type of an adjuster that supports this sensor section is prepared, which is very inconvenient.

In addition, maintenance information of the sensor section is preferably transmitted from the sensor section to the adjuster. Therefore, it is possible to easily determine maintenance timing.

In addition, the target selection unit may specify the target sensor section corresponding to the adjuster, on the basis of arbitrary selection of one identification number from one or more selectable identifiers that the sensor section has in advance and which are transmitted from the target sensor section. In this case, it is possible to easily select the target sensor section.

In addition, after the target sensor section is selected, a password is provided from the adjuster so as to be inputtable and is stored in the target sensor section and the adjuster. When setting of the operating condition is performed again by the adjuster that has stored the password, after the target sensor section is selected once, resetting of the operating condition is enabled without inputting the password.

Preferably, when the adjuster receives a plurality of identifiers from the target sensor section, the adjuster causes the adjustment notification unit to give notification of identification display information of a plurality of different colors, light, or sounds corresponding to the identifiers, and transmits the identification display information corresponding to the identifiers to a state notification unit of the target sensor section such that the identification display information is notified by the state notification unit; and the identification display information is selected by the adjustment notification unit of the adjuster and the target sensor section is specified. The identifier includes an identification number composed of numerals, sings, and the like, a character string, and the like. In this case, it is possible to immediately specify the target sensor section only with an operation of the adjuster.

Preferably, the sensor section includes: a mode switching unit configured to switch between a normal mode in which a detection operation is performed and a setting mode in which an operating condition is set; a transmitter configured to transmit detection rays for object detection; and a receiver configured to receive detection rays reflected from the object and output a detection signal, and detects the object on the basis of a signal level of the detection signal, and in the setting mode, the adjuster may be a remote controller configured to interactively communicate with the sensor section by sharing the detection rays of the sensor section as transmission means. Therefore, a transmission unit in the sensor section can be dispensed with, and thus it is possible to reduce the number of components and to reduce the cost.

Preferably, the sensor section includes a mode switching unit configured to switch between a normal mode in which a detection operation is performed and a setting mode in which an operating condition is set, and continuation of output of a detection signal from the sensor section is selectable in the setting mode. In this case, there is a case where in setting the operating condition, for example, due to air-conditioning, it is unfavorable to keep a door open; and it is also possible to cause the door to operate as normal to come into a closed state.

In addition, the adjuster is preferably connected to the sensor section via a communication network so as to be able to interactively communicate with the sensor section. In this case, it is possible to use, for example, a personal computer as the adjuster to perform remote control.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DESCRIPTION OF EMBODIMENTS

Figure 1:
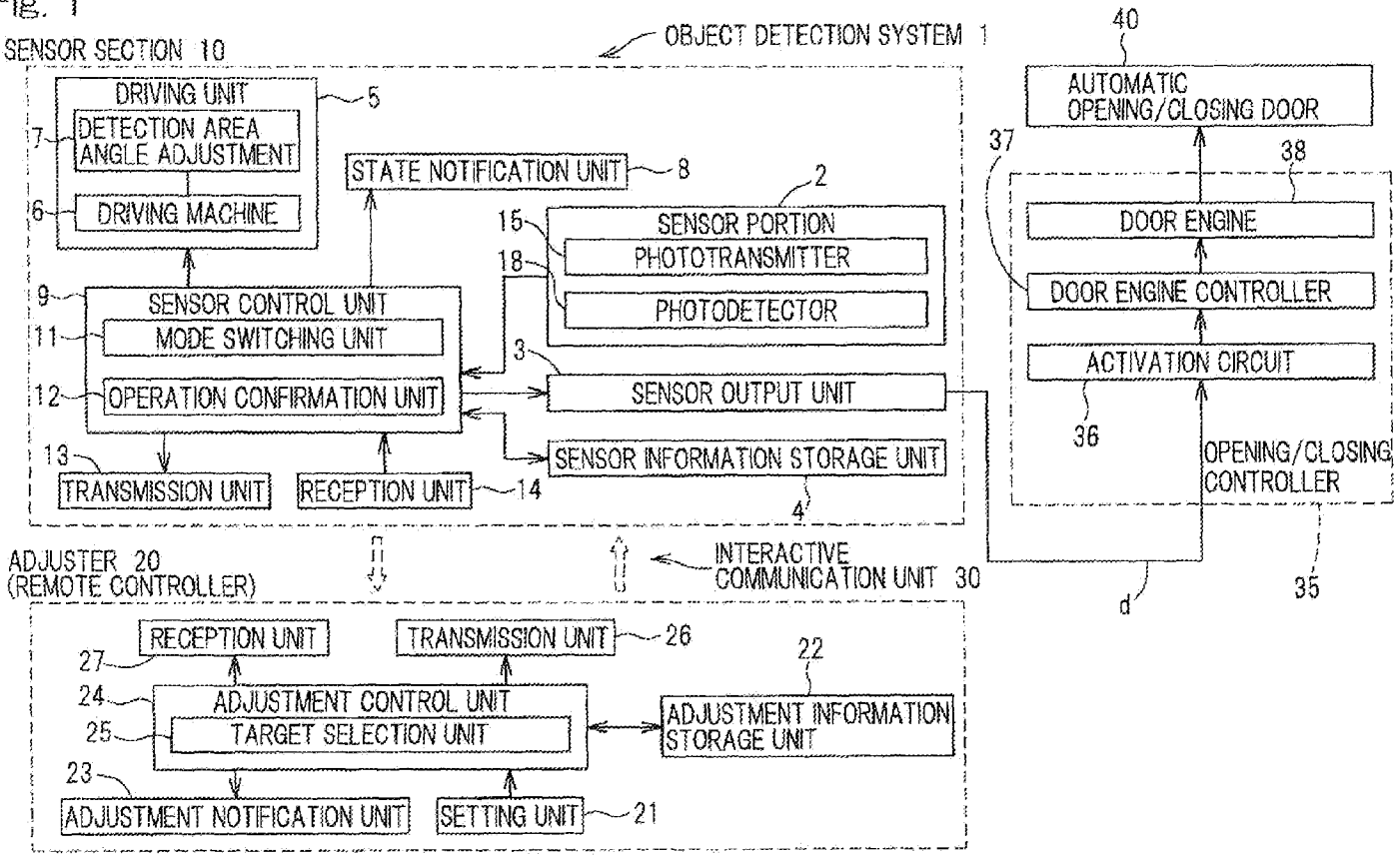
FIG. 1 is a block diagram showing the configuration of an object detection system according to an embodiment of the present invention.

Hereinafter, preferred embodiments of the present invention will be described with reference to the drawings. As shown in FIG. 1, an object detection system 1 according to an embodiment of the present invention includes an AIR (active infrared ray) type sensor section 10 which uses, for example, near infrared rays as detection rays; and an adjuster (remote controller) 20 which is provided independently from the sensor section 10 and interactively communicates with the sensor section 10 to set an operating condition of the sensor section 10. Here, only the single sensor section 10 and the single remote controller 20 are illustrated, but a plurality of sensor sections 10 are installed, and the same type of remote controllers 20 are used for these sensor sections 10, respectively.

Figure 2A:
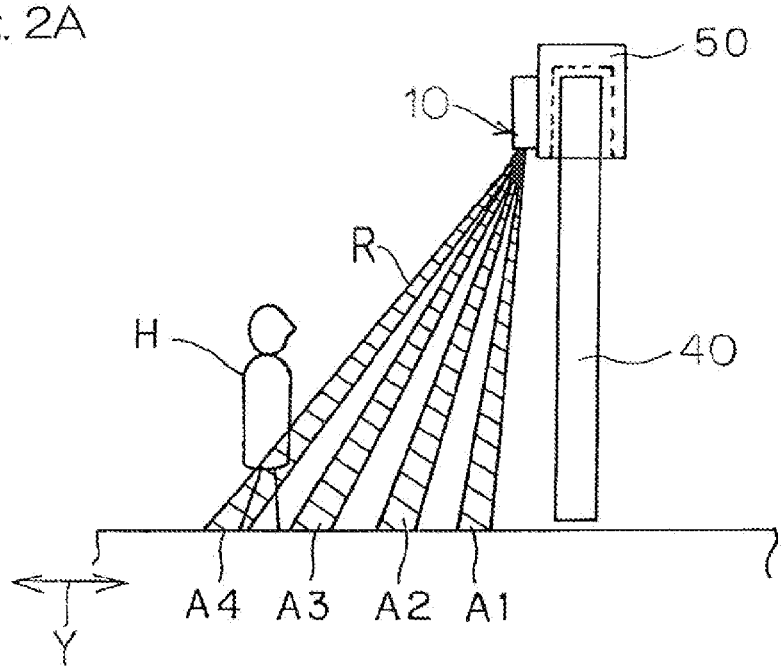
FIG. 2A is an explanatory diagram of a detection area as seen from a slide direction side of an automatic opening/closing door in the embodiment.
Figure 2B:
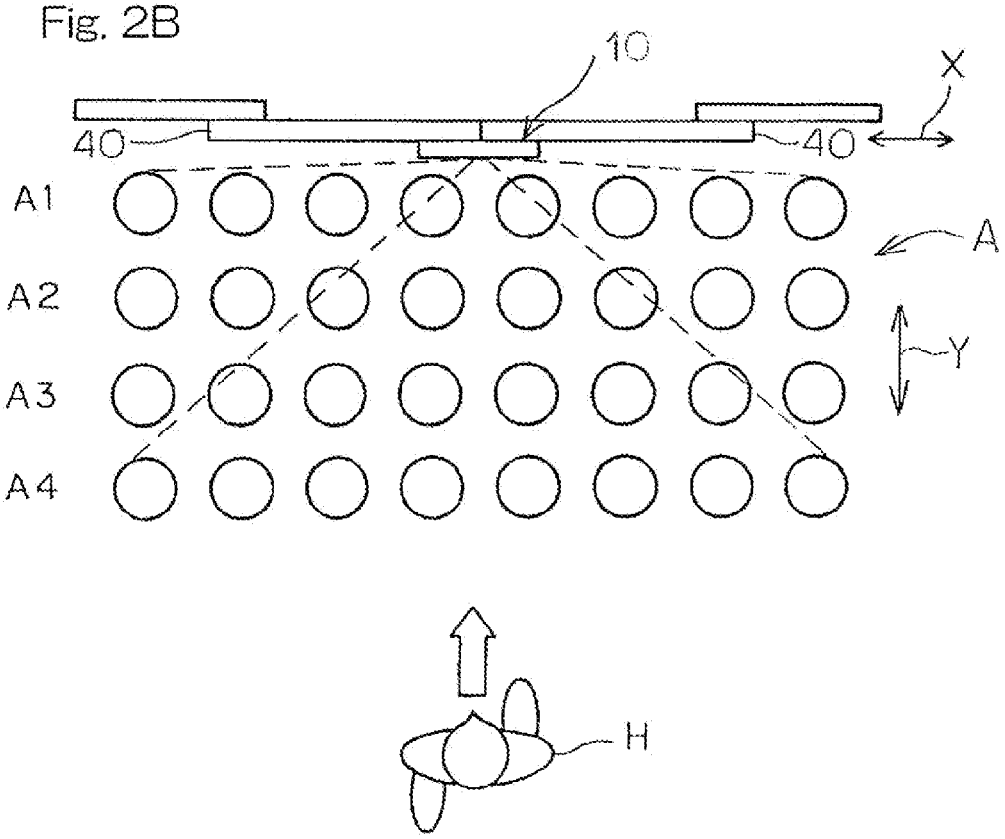
FIG. 2B is a plan view showing the detection area.

As shown in FIG. 2A, the sensor section 10 serves to detect an object within a detection area A and is mounted on a side surface of a transom 50. The object detection system 1 is used for opening and closing an automatic opening/closing door (automatic door) 40 which is a type of an automatic opening/closing apparatus. The detection area A is composed of, for example, four rows aligned in a front-rear (depth) direction Y from a position near the automatic door 40 toward a position away from the automatic door 40, and each of detection areas A1 to A4 of the respective rows is composed of 8 areas in a right-left (lateral) direction X as shown in FIG. 2B.

As shown in FIG. 1, an opening/closing controller 35 of the automatic door 40 installed outside the object detection system 1 includes an activation circuit 36 which outputs a door opening signal when an object detection signal d is inputted thereto from the sensor section 10; a door engine 38 which opens and closes an automatic door 30; and a door engine controller 37 which causes the door engine 38 to perform an opening/closing operation when receiving the door opening/closing signal from the activation circuit 36.

Figure 3:
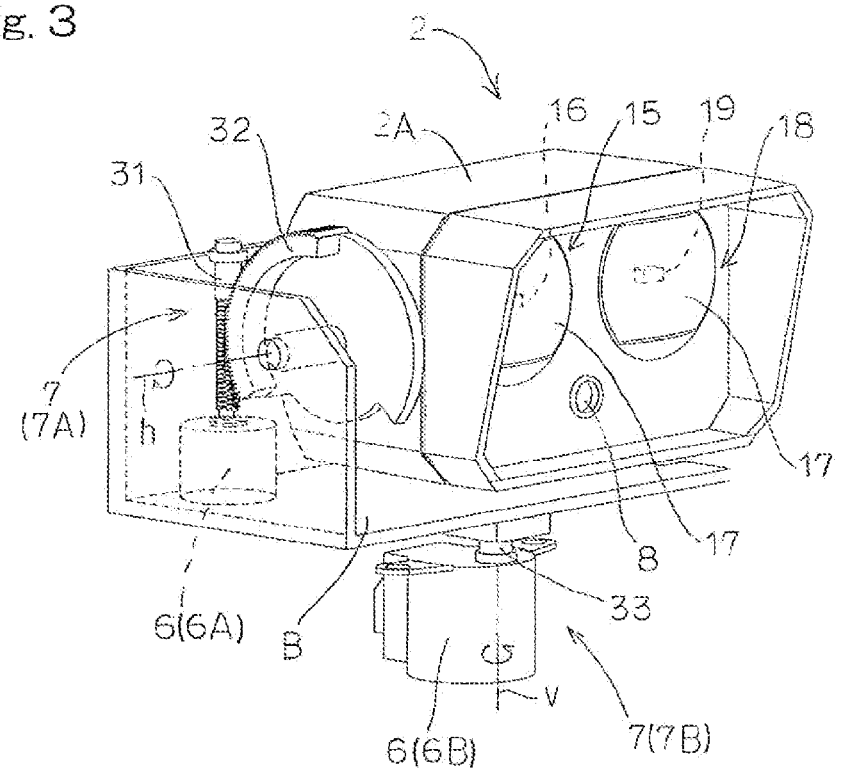
FIG. 3 is a schematic perspective view showing a sensor section according to the embodiment.

As shown in FIG. 3, the sensor section 10 includes a sensor portion 2 including: a phototransmitter 15 which projects detection rays such as near infrared rays for object detection; and a photodetector 18 which receives the detection rays. The sensor portion 2 is supported on a base B. In this example, the detection area A is formed on the basis of tilt angles of the phototransmitter 15 and the photodetector 18. The detection rays are emitted from a phototransmitter element 16 via an optical system 17 such as a lens toward the detection area A by the phototransmitter 15, the detection rays reflected on an object are received with a photodetector element 19 similarly via an optical system 17 by the photodetector 18, and the object is detected on the basis of the signal level of a light reception signal. When the object is detected, an object detection signal d is outputted from a sensor output unit 3 in FIG. 1 to the activation circuit 36.

As shown in FIG. 1, in addition to the sensor portion 2 and the sensor output unit 3, the sensor section 10 includes a sensor information storage unit 4, a driving unit 5 which adjusts the detection area A, a sensor section 10-side interactive communication unit 30 which interactively communicates with the remote controller 20, a state notification unit 8, and a sensor control unit 9 which controls the sensor section 10 in its entirety.

As shown in FIG. 3, the driving unit 5 includes a driving machine 6 such as a stepping motor; and a detection area angle adjustment mechanism 7 which is connected to the driving machine 6 and adjusts a tilt angle of a sensor main body 2A. The detection area angle adjustment mechanism 7 includes a vertical angle adjustment mechanism 7A which adjusts a vertical angle of the sensor main body 2A; and a horizontal angle adjustment mechanism 7B which adjusts a horizontal angle of the sensor main body 2A. The vertical angle adjustment mechanism 7A includes, for example, a horizontally rotary screw 31 and a vertical rotator 32 having, on an outer periphery thereof, a plurality of grooves so as to mesh with the horizontally rotary screw 31. The horizontally rotary screw 31 is rotated by driving of a motor 6A provided on the base B and the sensor main body 2A is rotated about a horizontal axis h by the vertical rotator 32 to be tilted in an up-down direction, thereby setting the vertical angle of the sensor main body 2A. The horizontal angle adjustment mechanism 7B includes a horizontally rotary shaft 33. The horizontally rotary shaft 33 is rotated by driving of a motor 6B provided below the base B and the sensor main body 2A is rotated about a vertical axis v together with the base B to be tilted in a right-left direction, thereby setting the horizontal angle of the sensor main body 2A. Although the tilt angle of the sensor main body 2A is adjusted in this example, a tilt angle of each optical system 17 may be adjusted.

Figure 4A:
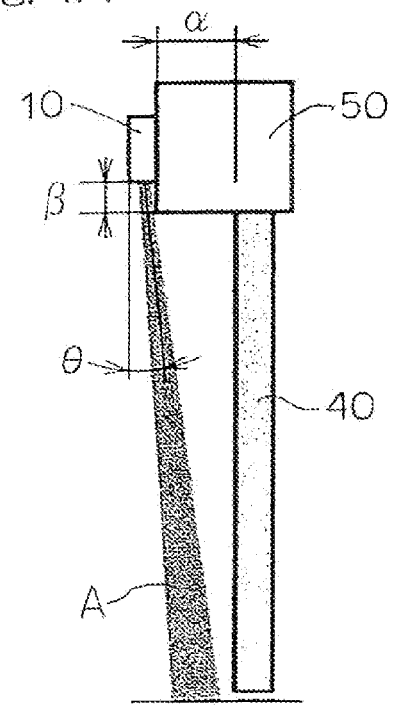
FIGS. 4A and 4B are explanatory diagrams showing an example of setting of the detection area.
Figure 4B:
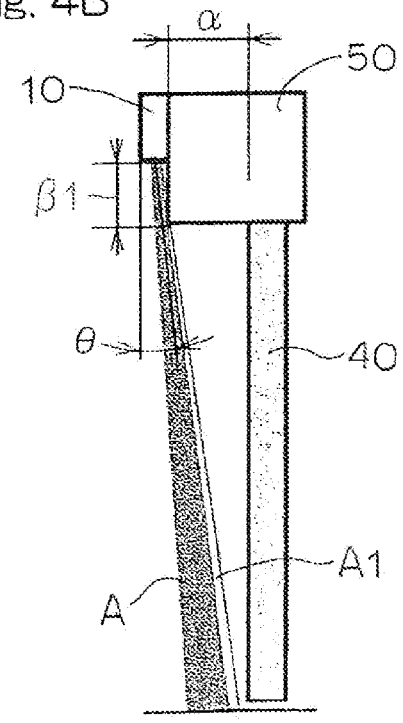

Angle adjustment of the detection area A is also performed such that the angle of the detection area A is set at an angle designated by the remote controller 20 on the basis of a detection ray reference angle which is determined on the basis of an irradiation state of the detection rays from the sensor section 10. For example, the angle of the detection area A is set at an angle designated by the remote controller 20 on the basis of a detection ray reference angle, in a depth direction of the sensor section 10, which is determined on the basis of the position of the sensor section 10 and diffusion of the detection rays. As shown in FIG. 4A, a detection ray reference angle θ in the depth direction of the sensor section 10 is determined on the basis of: a projection length α by which the sensor section 10 mounted on the transom 50 projects from the automatic door 40; a height β from the lower end of the transom 50; and a range where the detection rays diffuse. As shown in FIG. 4B, part of the detection rays is shielded by the transom 50 and the detection area A1 is not set as an effective detection area. Thus, this detection ray reference angle θ is determined such that the detection area A is set as an effective detection area, even if the height from the lower end of the transom 50 is β1. In addition, on the basis of the detection ray reference angle θ, it is possible to properly determine how close to the automatic door 40 the detection area A is to be set. Thus, it is possible to effectively and properly set the detection area A on the basis of the detection ray reference angle θ.

The sensor information storage unit 4 stores the operating condition and maintenance information of the sensor section 10 and a specific identifier allocated to each sensor section. The identifier includes an identification number composed of numerals, signs, and the like, a character string, and the like. These information items are transmitted (downloaded) to the remote controller 20 as described later. The operating condition includes items of detection sensitivity, interference prevention, a stationary detection time, false operation resistance (environment mode), installation position information of a target sensor unit, setting information of the detection area A, the above-described reference angle θ in the depth direction, and the like as well as items of validation/invalidation of the detection area A and an output kept time. The maintenance information includes items of the number of times of operation, an operating time, component deterioration information, a production lot, and the like. It should be noted that even when the plurality of sensor sections 10 are of different types, the identifier is preferably an identifier specific to each sensor section 10.

Examples of the contents of the operating condition include the heights of a plurality of levels for the detection sensitivity; a plurality of detection ray frequencies slightly different from each other, for the interference prevention; the lengths of a plurality of times for the stationary detection time; and environment states such as snow and rain, etc. for the environment. To each level, for example, a number such as "2. high" for the detection sensitivity or "3. rain" for the environment is added. In the remote controller 20, by inputting the number, the corresponding operating condition is selected.

The installation position information of a target sensor unit 10 intended for the operating condition setting includes a sensor mounted height for adjusting the detection area A, a center deviation and a front-rear deviation of the sensor section 10 relative to the automatic door 40, and the like. The setting information of the detection area A includes the number of rows (e.g., 2 to 5 rows) in the depth of the set detection area A and the number of columns (e.g., 3 to 8 columns) in the width of the set detection area A.

In this example, when the target sensor section 10 is selected from among the plurality of sensor sections 10, all the setting items of the operating condition of the sensor section 10 are transmitted together to the remote controller 20. Thus, the remote controller 20 is able to perform setting for any sensor section 10 and does not need to perform transmission each time setting is performed.

The interactive communication unit 30 includes a pair of a transmission unit 13 and a reception unit 14 at the sensor section 10 side and a pair of a transmission unit 26 and a reception unit 27 at the later-described remote controller 20 side, and may be, for example, of a wireless type using near infrared rays or the like or of a wired type. The state notification unit 8 in the sensor section 10 is for example, a visible LED and gives notification of a response to the remote controller 20.

The sensor control unit 9 includes a mode switching unit 11 and an operation confirmation unit 12. The mode switching unit 11 switches between a normal mode in which the sensor section 10 performs a detection operation and a setting mode in which the operating condition of the sensor section 10 is set. The setting mode is generally used when the object detection system 1 is installed, when a setting change is made, etc., and the operating condition of the sensor section 10 is set therein.

The operation confirmation unit 12 confirms an operation of the driving machine 6 for a short time period at arbitrary intervals. Since the detection area A is used when the object detection system 1 is installed, etc. as described above, the driving machine 6 may not operate for a long time period. Thus, when the driving machine 6 is abruptly caused to operate, the driving machine 6 does not properly and smoothly operate in some cases. Therefore, the driving machine 6 is caused to operate by the operation confirmation unit 12, for example, once a day for 1 sec when the door is opened in the normal mode. By so doing, even when the driving machine 6 has not been caused to operate for a long period of time, it is possible to cause the driving machine 6 to properly and smoothly operate in setting.

Also, when the object detection system 1 is installed at a low-temperature location and the ambient temperature is lower than the operating temperature of the driving machine 6, the sensor section 10 may be preliminarily powered on or energized, and if the ambient temperature has not reached the operating temperature of the driving machine 6 in setting the detection area A, an adjustment notification unit 23 of the remote controller 20 may be caused to give notification of setting standby. Thus, even when the object detection system 1 is installed at a low-temperature location, it is possible to cause the driving machine 6 to operate in a proper state.

Furthermore, the sensor section 10 causes continuation of output of an object detection signal from the sensor section 10 to be selectable in the setting mode. Thus, there is a case where in the setting mode, due to air-conditioning, it is disadvantageous to keep the door open, and in this case, it is also possible to cause the automatic door 40 to operate as normal to come into a closed state.

The adjuster (remote controller) 20 in FIG. 1 includes a setting unit 21 such as a numeric keypad with which the operating condition of the sensor section 10 including adjustment of the detection area A by the driving machine 6 is set; an adjustment information storage unit 22; the adjustment notification unit 23; an adjustment control unit 24 which controls the remote controller 20 in its entirety; and a remote controller 20-side interactive communication unit 30 which interactively communicates with the sensor section 10.

Figure 5:
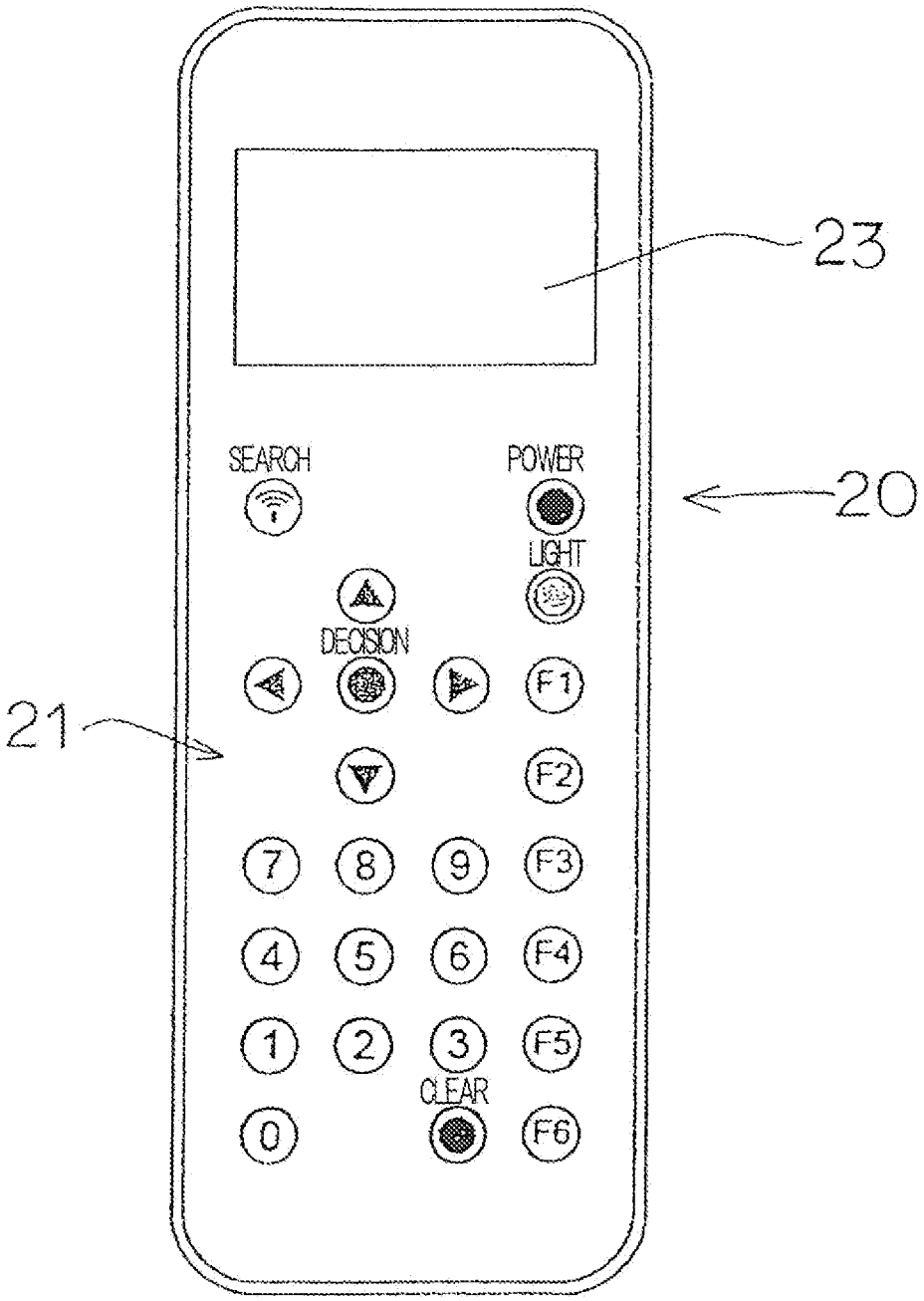
FIG. 5 is a plan view showing an adjuster (remote controller) according to the embodiment.

FIG. 5 shows a plan view of the remote controller 20. The adjustment notification unit 23 is located at an upper portion, and the numeric keypad 21 is located below the adjustment notification unit 23. In the numeric keypad 21, a power key, a search key, a decision key, and the like are provided in addition to numeric keys.

The adjustment control unit 24 includes a target selection unit 25 which arbitrarily selects a target sensor unit 10 intended for operating condition setting, from among a plurality of identifiers. On the basis of arbitrary selection of one identifier from among the plurality of identifiers transmitted from the target sensor unit 10, the target selection unit 25 selects the target sensor unit 10 corresponding to the remote controller 20. Thereafter, a selected and determined content is transmitted to the target sensor unit 10 corresponding to the identifier selected by the remote controller 20. When the target sensor unit 10 transmits to the remote controller 20 again a response that the target sensor unit 10 has received the content, the content is displayed on the adjustment notification unit 23.

Owing to the target selection unit 25, even in the case where the plurality of sensor sections 10 are provided, it is possible to easily select only an arbitrary sensor section 10 by the remote controller 20 of the same type, and it is possible to prevent false setting of another sensor section 10. In addition, it is possible to easily set the operating condition for each sensor section 10 by using the remote controller 20. It should be noted that in the case where setting is performed for a single sensor section 10 by a single remote controller 20, only one identifier of a target sensor unit 10 may be selected or may automatically come into a selected state.

After the target sensor unit 10 is selected, a password is provided from the remote controller 20 so as to be inputtable and is stored in the respective storage units 4 and 22 of the target sensor unit 10 and the remote controller 20. Therefore, in resetting the operating condition, it is possible to be dispensed with inputting of the password for the remote controller 20 that has stored the password.

As the interactive communication unit 30, the pair of the transmission unit 26 and the reception unit 27 are provided at the remote controller 20 side. The setting information of the operating condition and the maintenance information of the sensor section 10, the specific identifier assigned to each sensor section 10, a completion signal of operating condition setting from the sensor section 10, and the like are transmitted from the transmission unit 13 of the sensor section 10 to the reception unit 27 of the remote controller 20, and a decision signal for the sensor section 10 selected on the basis of the plurality of identifiers, a setting signal, a set password, and the like from the numeric keypad 21 are transmitted from the transmission unit 26 of the remote controller 20 to the reception unit 14 of the sensor section 10.

Under control of the adjustment control unit 24, in accordance with a request from the remote controller 20, the above-described setting information of the operating condition, the above-described maintenance information, and the like are transmitted from the sensor section 10 via the interactive communication unit 30 to the remote controller 20. It should be noted that each information item may be transmitted even without a request from the remote controller 20.

The adjustment information storage unit 22 of the remote controller 20 stores the transmitted setting information of the operating condition of the sensor section 10, the plurality of identifiers, and the like as well as an actually set operating condition and the like. In addition, the maintenance information and the number of times of actual operations and an actual operation time which are accumulated for each sensor section 10 in the normal mode by a counter which is not shown, are also stored in the adjustment information storage unit 22. Therefore, it is possible to easily determine maintenance timing for each sensor section 10. Furthermore, the completion signal of operating condition setting and the like from the sensor section 10, the setting signal, the set password, and the like from the numeric keypad 21 are stored in the adjustment information storage unit 22.

The adjustment notification unit 23 is, for example, an LCD and gives notification of the operating condition from the sensor section 10, an operating condition, setting of which has been completed by an operation of the numeric keypad 21, or reception of a completion signal from the sensor section 10, on a screen thereof by means of characters. It should be noted that the adjustment notification unit 23 may give notification by means of a sound, a color, or light other than characters.

In addition, when the remote controller 20 receives a plurality of identifiers from the target sensor unit 10, the remote controller 20 causes the adjustment notification unit 23 to give notification of identification display information of a plurality of different colors, light, or sounds corresponding to the identifiers, and transmits the identification display information corresponding to the identifiers, to the state notification unit 8 of the target sensor unit 10 such that the identification display information is notified by the state notification unit 8. The identification display information is selected by the adjustment notification unit 23 of the remote controller 20 and the target sensor unit 10 is specified. Thus, it is possible to immediately specify the target sensor unit 10 only with a key operation of the remote controller 20.

It should be noted that in the setting mode, the remote controller 20 may be an optical remote controller which interactively communicates with the sensor section 10 by sharing the detection rays of the sensor section 10 as transmission means. In other words, the phototransmitter 15 of the sensor section 10 is shared as the transmission unit 13. In this case, a transmission unit in the sensor section can be dispensed with, and thus it is possible to reduce the number of components and to reduce the cost.

Figure 6:
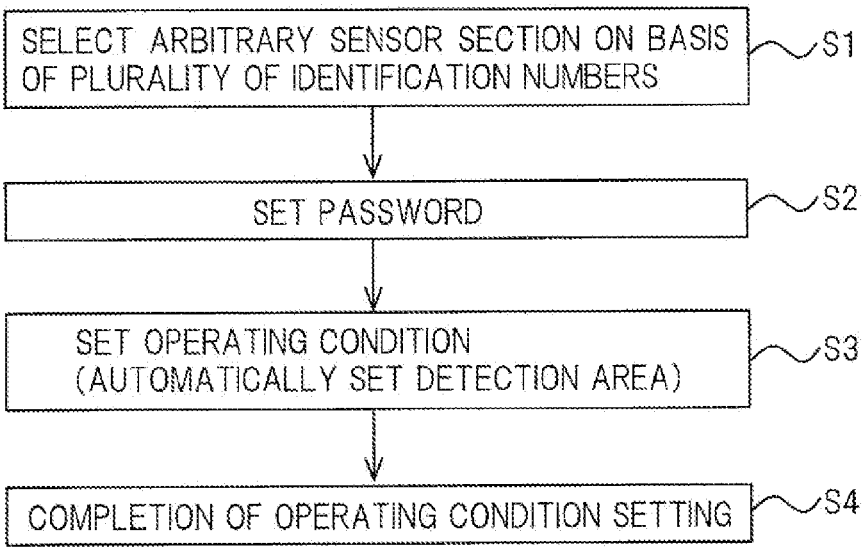
FIG. 6 is a flowchart showing an operation of the object detection system.
Figure 7:
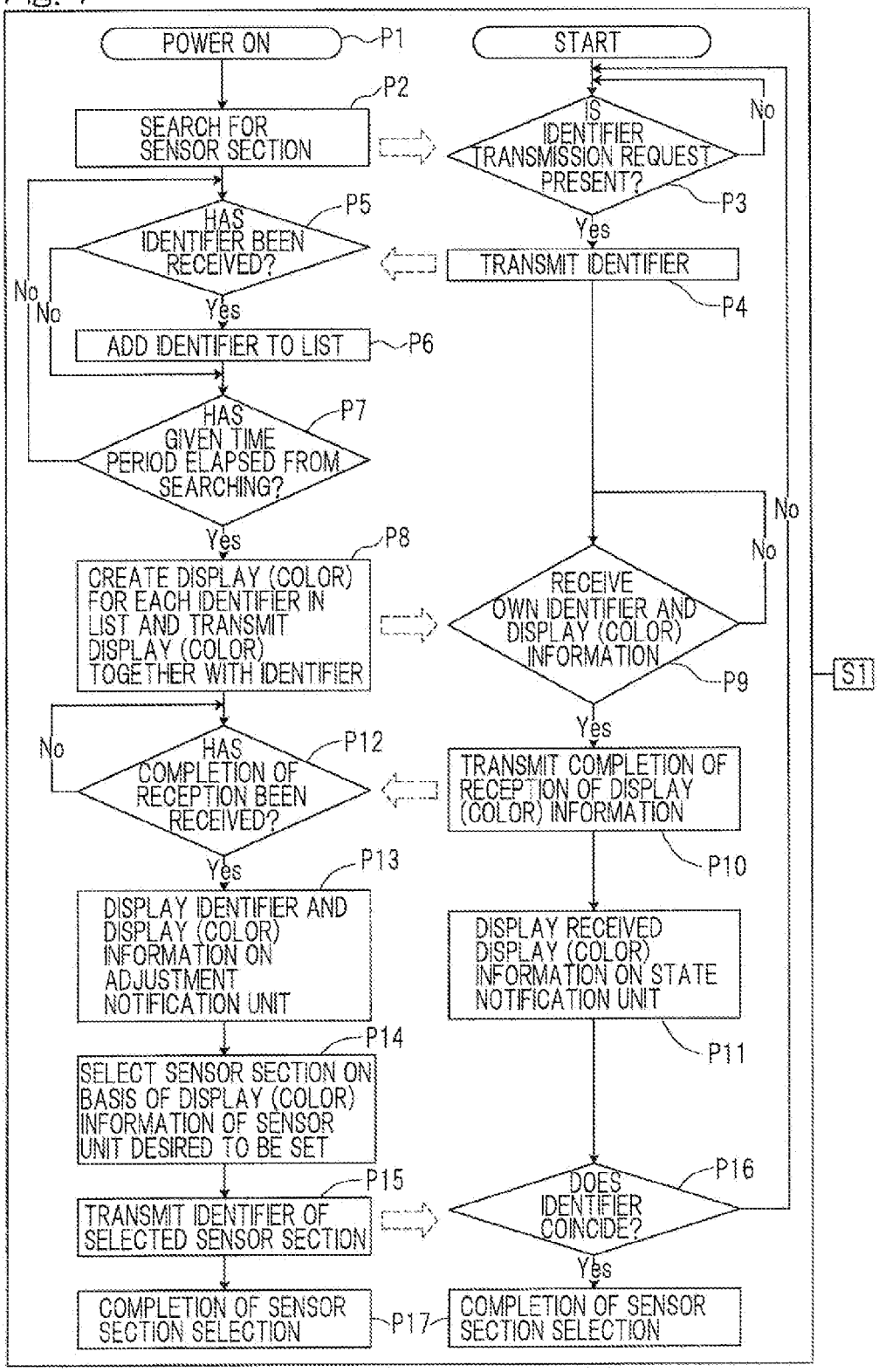
FIG. 7 is a detailed flowchart of step S1 in the flowchart in FIG. 6.

Hereinafter, an operation of the object detection system configured as described above will be described. FIG. 6 is a flowchart showing an operation of the adjuster (remote controller) 20. In addition, FIG. 7 is a detailed flowchart of step S1 in FIG. 6 in which step S1 a sensor section 10 desired to be set is selected from the plurality of sensor sections 10. In FIG. 7, first, the power key of the remote controller 20 is pressed, thereby turning on the power (P1). Next, when the search key is pressed for searching for the sensor section 10 (P2), it is confirmed on the basis of transmission for the searching, whether a transmission request of transmitting an identifier such as an identification number is present in the sensor section 10 (P3).

When the transmission request is present, the identifier is transmitted from the sensor section 10 to the remote controller 20 (P4), and it is confirmed in the remote controller 20 whether the identifier has been received (P5). When the identifier is received, the identifier is added to a list (P6), and it is confirmed whether a given time period has elapsed from the searching (P7). When the given time period has elapsed, a display (color) for each identifier in the list is created and transmitted together with the identifier to the sensor section 10 (P8). Then, it is confirmed in the sensor section 10 whether the own identifier and the display (color) information have been received (P9). When the identifier and the display (color) information are received, completion of the reception of the display (color) information is transmitted to the remote controller 20 (P10). In the sensor section 10, the received display (color) information is displayed on the state notification unit 8 (P11).

Meanwhile, in the remote controller 20, it is confirmed whether the completion of the reception has been received (P12). When the completion of the reception is received, display (color) information corresponding to each of selectable identifiers of a plurality of sensors is displayed on the adjustment notification unit 23 together with each identifier (P13). A sensor section 10 desired to be set is selected on the basis of the display (color) information (P14).

In this example, simplified identifiers XXXX1 and XXXX2 are used, and "1. XXXX1: red" and "2. XXXX2: blue" are displayed on the adjustment notification unit 23. At that time, a red LED indicating a sensor section 10 corresponding to the identifier XXXX1 and a blue LED indicating a sensor section 10 corresponding to the identifier XXXX2 blink in the state notification unit 8 of each sensor section 10. Next, for example, when a numeric key "1" is pressed, the sensor section 10 of the identifier XXXX1 is selected. When the sensor section 10 is selected, the sensor section 10 corresponding to the identifier XXXX1 comes into a state where setting of a password is enabled, and performs a display, for example, by shortening the blinking cycle of the red LED. The sensor section 10 corresponding to the identifier XXXX2 that has not been selected returns to the original operation state, for example, to green which is an original color.

Next, in the remote controller 20, the identifier of the selected sensor section 10 is transmitted to the sensor section 10 (P15), and it is confirmed in the sensor section 10 whether the received identifier coincides with the own identifier (P16). If the received identifier coincides with the own identifier, the selection of the sensor section 10 is completed (P17). In this manner, an arbitrary sensor section 10 is selected on the basis of the plurality of identifiers (step S1). Thus, it is possible to select only an arbitrary sensor section 10 by the remote controller 20 of the same type, and even when any remote controller 20 is used, it is possible to finally cause the remote controller 20 to individually correspond to an arbitrary sensor section 10 in a one-to-one relation after setting.

Next, as shown in FIG. 6, subsequently to step S1, "Please input password" is displayed on the adjustment notification unit 23. For example, when an arbitrary password of 4 digits is inputted and the decision key is pressed, the password is set (step S2). The password is stored in both the storage units 4 and 22 of the sensor section 10 and the remote controller 20. Thereafter, the operating condition, the maintenance information, and the like are transmitted from the sensor section 10 to the remote controller 20. It should be noted that if each of the storage units 4 and 22 of the sensor section 10 and the remote controller 20 have stored a password and the passwords stored therein coincide with each other, the operating condition, the maintenance information, and the like are transmitted at the time when a target sensor section 10 is selected in step S1.

Then, each transmitted operating condition is sequentially displayed on the screen of the adjustment notification unit 23. When the transmitted contents are changed, each content is changed by operating the numeric keys and the like of the remote controller 20. Each setting signal is transmitted from the remote controller 20 to the sensor section 10, and each operating condition (detection area automatic setting) is set in the sensor section 10 on the basis of the setting signal (step S3). In this manner, for example, "2. high" for the detection sensitivity, "3. rain" for the environment, and the like in the operating condition are set.

Figure 8A:
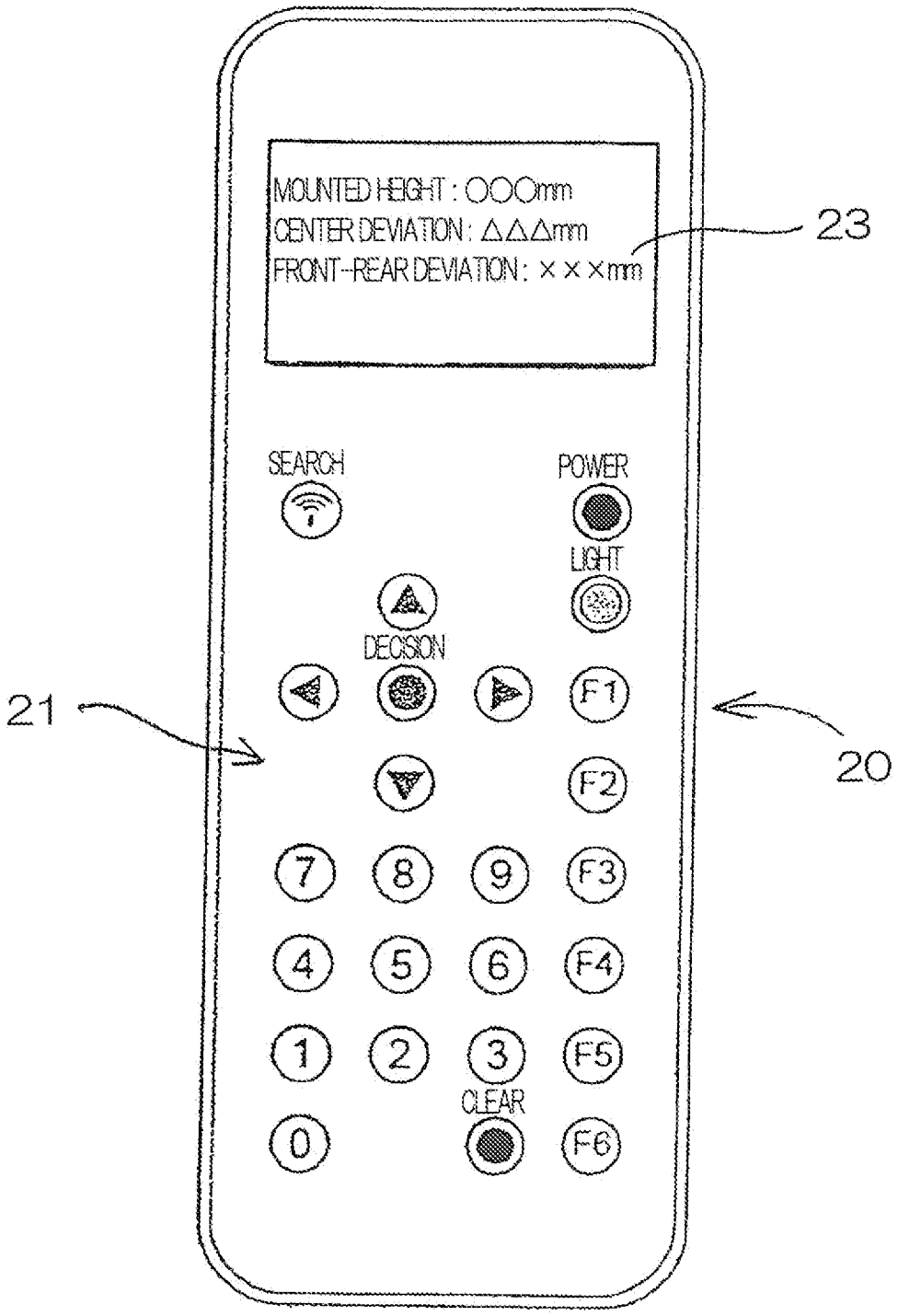
FIGS. 8A and 8B are plan views showing an example of an operation of the remote controller.
Figure 8B:
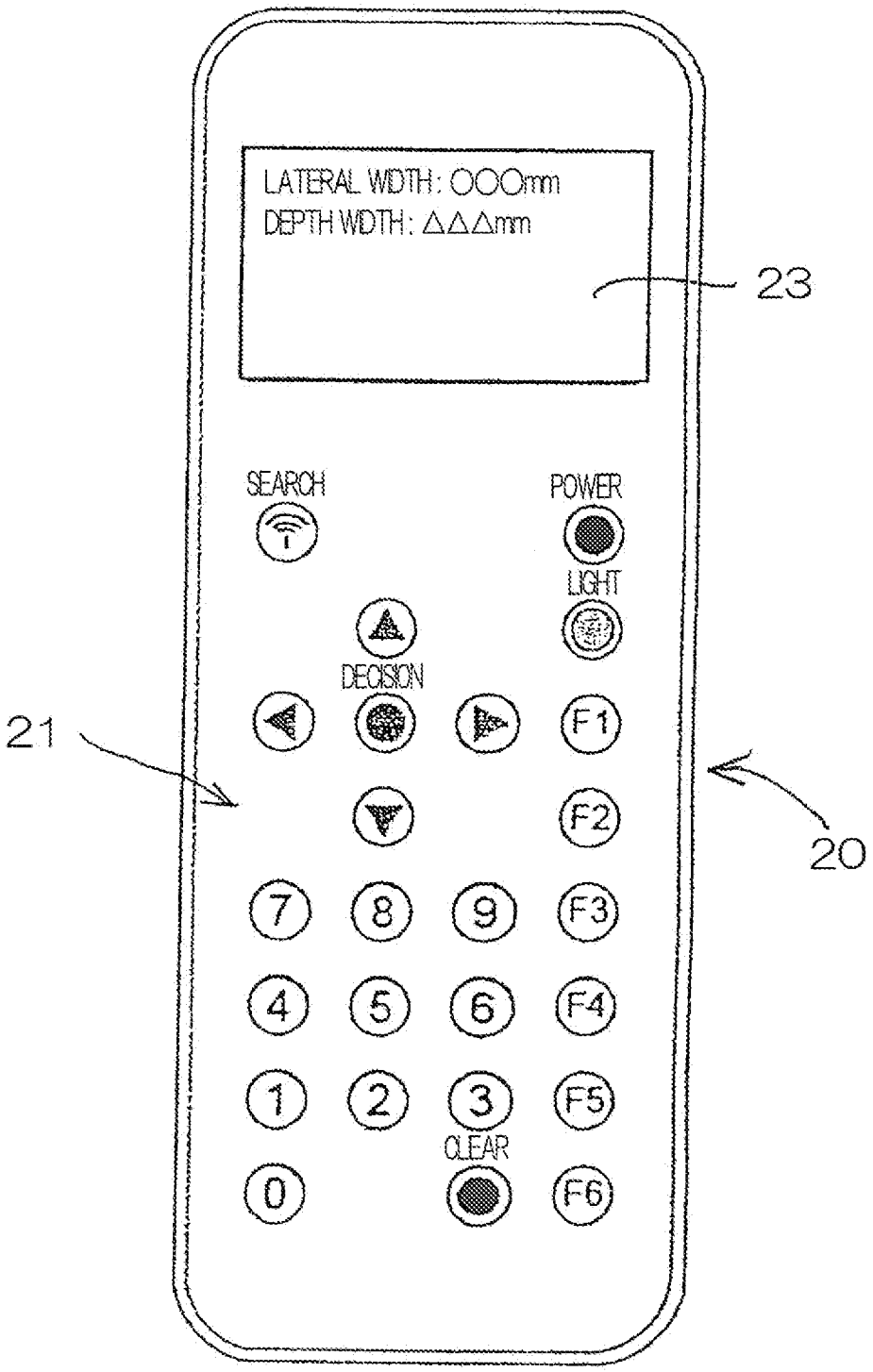

In the automatic setting of the detection area A in step S3, the transmitted installation position information of the target sensor unit 10 and the transmitted setting information of the detection area A are sequentially displayed on the screen of the adjustment notification unit 23. FIG. 8A shows an example of a mounted height, a center deviation, and a front-rear deviation of the sensor section 10 in the installation position information displayed on the screen, and FIG. 8B shows an example of a width (lateral width) and a depth (depth width) in the setting information of the detection area A.

Figure 9A:
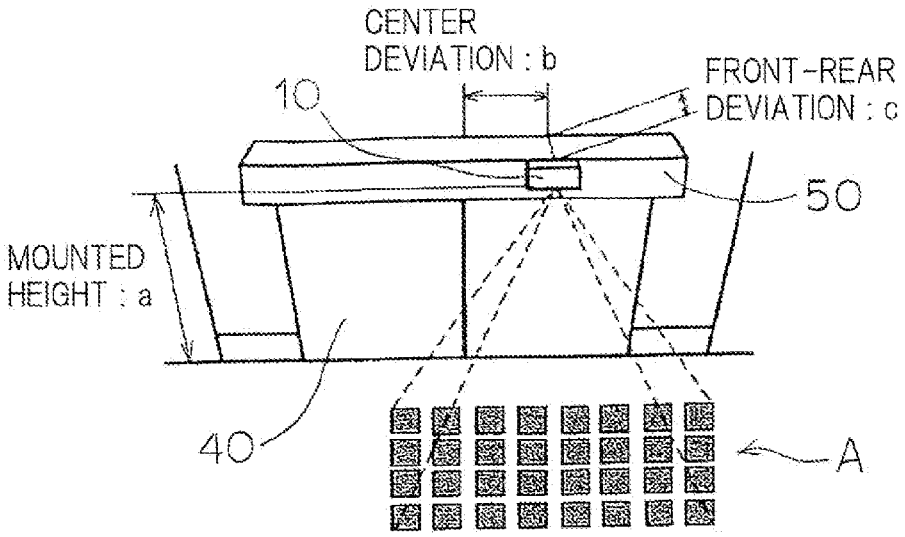
FIGS. 9A and 9B are explanatory diagrams showing an example of setting of the detection area.
Figure 9B:
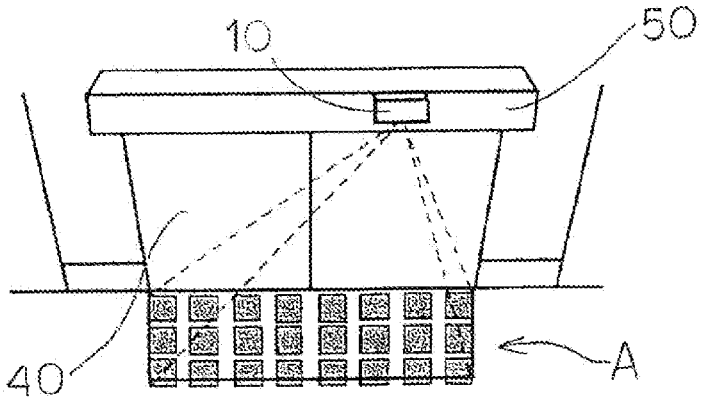

FIGS. 9A and 9B show an example of setting of the detection area A. FIG. 9A shows a mounted height a, a center deviation b, and a front-rear deviation c of the sensor section 10 in the installation position information, and a width (8 columns) and a depth (4 rows) in the setting information of the detection area A and the position of the detection area A which is shifted on the basis of the center deviation b and the front-rear deviation c are indicated.

On the basis of the center deviation b and the front-rear deviation c of the sensor section 10, the tilt angle of the sensor main body 2A is set such that the detection area A is located at a proper position for the automatic door. In addition, when setting is performed by the numeric keys and the decision key is pressed in the case where the detection area A is desired to be changed to have a width (8 columns) and a depth (3 rows), the setting signal is transmitted to the target sensor unit 10. Then, in the target sensor unit 10, on the basis of the setting signal, the detection area angle adjustment mechanism 7 is caused to operate by driving of the driving machine 6 and the detection area A is automatically set.

At the end, a completion signal of all the operating condition setting is transmitted from the target sensor unit 10, and completion of operating condition setting is displayed on the adjustment notification unit 23 of the remote controller 20 (step S4). FIG. 9B shows the set detection area A having a width (8 columns) and a depth (3 rows). Thus, it is possible to automatically set the detection area A with a simple configuration.

As described above, in the present invention, since the adjuster (remote controller) includes the target selection unit which arbitrarily selects a target sensor section intended for operating condition setting, even in the case where a plurality of sensor sections are provided, it is possible to select only an arbitrary sensor section by a remote controller of the same type, and thus it is possible to prevent false setting of another sensor section. Furthermore, it is possible to easily set the operating condition for each sensor section by the adjuster.

In addition, since the setting information of each operating condition is previously stored in each sensor section, for example, even when the types of the sensor sections are different and thus the operating condition items are different, it is possible to handle this case with only one type of a remote controller by transmitting the operating condition of only a target sensor section in combination with arbitrary selection of a sensor section. Thus, the development cost is reduced. Moreover, for a user, it is possible to easily set an operating condition of an arbitrary sensor section. Furthermore, since one type of the remote controller is used, the operation is the same, and management is not complicated.

It should be noted that in the above-described embodiment, near infrared rays are used as the detection rays, but the present invention is not limited thereto, and far infrared rays, ultrasonic waves, microwaves (MW), and the like may be used.

In addition, in the above-described embodiment, the object detection system is applied to the automatic door apparatus, but the present invention is not limited thereto, and the object detection system is also applicable to an automatic shutter which opens/closes up and down and a security sensor device. Moreover, the object detection system is installed on the transom, but may be installed on a ceiling or the like.

It should be noted that in the above-described embodiment, the adjuster is connected to the sensor section wirelessly or via a wire so as to be able to interactively communicate with the sensor section, but the adjuster may be connected to the sensor section via a communication network so as to be able to interactively communicate with the sensor section. In this case, it is possible to use, for example, a personal computer as the adjuster to remotely control setting of an operating condition or the like.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

REFERENCE NUMERALS

1 . . . object detection system
6 . . . driving machine (motor)
7 . . . detection area angle adjustment mechanism
8 . . . state notification unit
9 . . . sensor control unit
10 . . . sensor section
11 . . . mode switching unit
12 . . . operation confirmation unit
13 . . . transmission unit
14 . . . reception unit
20 . . . adjuster (remote controller)
21 . . . setting unit
23 . . . adjustment notification unit
24 . . . adjustment control unit
25 . . . target selection unit
26 . . . transmission unit
27 . . . reception unit
30 . . . interactive communication unit
40 . . . automatic opening/closing door (automatic door)
A (A1 to A4) . . . detection area
X . . . right-left (lateral) direction
Y . . . front-rear (depth) direction

What is claimed is:

1. An object detection system comprising:

a plurality of sensor sections that detect an object within a detection area; and one type of remote controller that interactively communicates with at least one of the plurality of sensor sections, wherein the remote controller includes:

a transmitter that transmits a setting signal for setting an operating condition of at least one of the sensor sections to said at least one of the plurality of sensor sections;

an adjustment notifier that receives a completion signal of operating condition setting from said at least one of the plurality of sensor sections and gives notification of the operating condition, setting of which has been completed; and a target selector that arbitrarily selects a target sensor section intended for the operating condition setting, wherein setting information of the operating condition is transmitted from said at least one of the plurality of sensor sections to the remote controller, and the target selector specifies the target sensor section corresponding to the remote controller, on the basis of arbitrary selection of one identification number from one or more selectable identifiers that said at least one of the plurality of sensor section has in advance and which are transmitted from the target sensor section;

wherein after the target sensor section is selected, a password is provided from the remote controller so as to be inputtable and is stored in the target sensor section and the remote controller, and when setting of the operating condition is performed again by the remote controller that has stored the password, after the target sensor section is selected once, resetting of the operating condition is enabled without inputting the password.

2. An objection detection system comprising:

a plurality of sensor sections that detect an object within a detection area; and one type of remote controller that interactively communicates with at least one of the sensor sections, wherein the remote controller includes:

a transmitter that transmits a setting signal for setting an operating condition of at least one of the sensor sections to said at least one of the plurality of sensor sections;

an adjustment notifier that receives a completion signal of operating condition setting from said at least one of the plurality of sensor sections and gives notification of the operating condition, setting of which has been completed; and a target selector that arbitrarily selects a target sensor section intended for the operating condition setting, wherein setting information of the operating condition is transmitted from said at least one of the plurality of sensor sections to the remote controller, and the target selector specifies the target sensor section corresponding to the remote controller, on the basis of arbitrary selection of one identification number from one or more selectable identifiers that said at least one of the plurality of sensor section has in advance and which are transmitted from the target sensor section;

wherein when the remote controller receives a plurality of identifiers from the target sensor section, the remote controller causes the adjustment notifier to give notification of identification display information of a plurality of different colors, light, or sounds corresponding to the identifiers, and transmits the identification display information corresponding to the identifiers to a state notifier of the target sensor section such that the identification display information is notified by the state notifier, and the identification display information is selected by the adjustment notifier of the remote controller and the target sensor section is specified.

* * * * *